US005515791A

United States Patent [19]

Britzke et al.

[11] Patent Number: 5,515,791

[45] Date of Patent: May 14, 1996

[54] INSIDE LINING OF A PASSAGE, WITH BELLOWS, BETWEEN TWO VEHICLES

[75] Inventors: Ingo Britzke, Kassel; André Goebels, Niederbeisheim, both of Germany

[73] Assignee: Hübner Gummi - Und Kunststoff GmbH, Kassel, Germany

[21] Appl. No.: 237,121

[22] Filed: May 3, 1994

[30] Foreign Application Priority Data

May 8, 1993 [EP] European Pat. Off. ..... 93107501

[51] Int. Cl.[6] ..... B61D 17/20

[52] U.S. Cl. ..... 105/8.1

[58] Field of Search ..... 105/8.1, 3, 15–18

[56] References Cited

U.S. PATENT DOCUMENTS 4,318,345 3/1982 Kleim ..... 105/15

4,781,123 11/1988 Yoshihara ..... 105/8.1

FOREIGN PATENT DOCUMENTS 061680 3/1982 European Pat. Off. .

3639898 6/1988 Germany .

380186 9/1964 Switzerland .

*Primary Examiner*—Robert J. Oberleitner

*Assistant Examiner*—S. Joseph Morano

*Attorney, Agent, or Firm*—Collard & Roe

[57] ABSTRACT

Inside lining of a passage between two vehicles, in particular of a passage with a bellows, comprising a side wall cover which is designed as a plate inherently elastically yielding and being arched around the vertical axis of plane in the direction of the center of the passage.

27 Claims, 11 Drawing Sheets

INSIDE LINING OF A PASSAGE, WITH BELLOWS, BETWEEN TWO VEHICLES

BACKGROUND OF THE INVENTION

1. Field of the Invention

The present invention relates to an inside lining of a passage between two vehicles, in particular of a passage with a bellows, comprising a side wall cover which is designed as a plate inherently elastically yielding, and being arched around the vertical axis of plane in the direction of the center of the passage.

2. The Prior Art

Inside linings of passages are required in order to protect the bellows against destruction by passengers. DE-A 3,639,898 describes a known passage with an inside lining. This inside lining is characterized by an inner lining element and two outer lining elements, whereby the inner lining element is displaced relative to the outer lining elements when the train travels around a curve. Such a construction requires a relatively high expenditure and is, therefore, costly.

SUMMARY OF THE INVENTION

It is an object of the present invention to provide a reasonably priced inside lining with an entirely different design principle.

According to the invention, the problem is solved in that the side wall cover is designed as a plate that is elastically yielding in itself and arched around the vertical axis of plane in the direction of the center of the passage. In this connection, the side wall cover can be connected with the respective vehicle body in an articulated manner. According to an advantageous feature, the side wall cover is connected with the respective body of the vehicle by elastically yielding connection means. What is achieved through this constructional design is that the side wall cover is capable of yielding to all occurring motions of travel. Owing to the elastic design of the connection means, the inside lining is capable of absorbing diagonal stresses, as they occur due to rocking and pitching movements and changes in altitude of the cars among one another. Such movements cannot be absorbed by the side wall cover only to a minor extent because this side wall cover, even if it is elastic within itself within certain limits, must nevertheless still have a relatively high rigidity in order not to yield when passengers lean against it. Moreover, the absorption of diagonal movements is highly limited also by the curvature of the side wall cover.

The prestressing for producing the curvature can be caused by connecting the vertical ends of the side wall cover with each other by wire ropes.

More particularly, the yielding connection means comprises a hinge, as well as an elastic element designed, for example, as a wall, which connects the hinge with the side wall cover. The hinge is located next to the side wall cover. Particularly due to the use of the elastic element designed as a wall, such elements being, for example, a rubber plate, such an inside lining is capable of absorbing the known diagonal movements.

In detail, the hinge is articulated on the elastic element approximately parallel with a line extending parallel with the longitudinal axis of the passage, so that at the end side, the elastic element extends angularly relative to the longitudinal axis of the passage. In this connection, the hinge is connected with the body of the vehicle by a first butt strap via the coupling frame of the bellows, and with the elastic element by a further butt strap which, in its starting position, is disposed parallel with the longitudinal axis of the passage. For the connection with the elastic element, the butt strap has a mounting with a radius, against which the elastic element is resting. Therefore, the side wall cover is capable of following the stretching of a vertical side of the bellows, as it occurs when the train travels around a curve, because the elastic element, which is designed as a wall and articulated on the butt strap of the hinge, forces the butt strap into a swivel motion which, overall, leads to a stretching of the connection means. When the connection means are stretched, the elastic element is continuously lifted off the radius.

By using a spring hinge, the corresponding reset force can be produced at the same time as well. For producing the reset motion, the spring hinge is prestressed in such a way that the side wall cover is pulled in the direction of the respective vehicle body.

Furthermore, within the zone of articulation of the spring hinge, provision is made for a stop for the spring hinge for limiting the swivel angle. In order to prevent the space of the hinge from being engaged when the hinge is swivelled, provision is made for a screening of the space around the spring hinge.

According to another embodiment of the invention, provision is made for a gap cover between the vehicle body and the connection means, whereby the gap cover is located on the vehicle body. When the radius of the screening and the radius of the mounting are substantially the same and extend parallel with the radius of the butt strap of the spring hinge, it is assured in this way that no gap can be formed between the gap cover and the mounting with the elastic element or screening during the swivel motion of the hinge.

When travelling around a curve, the movement process can be described as follows. Within the range of the inner curve, the side wall cover is bulged further inwardly, whereby the elastic element designed as a wall is at least partially lifted off the radius of the mounting.

Within the range of the outer curve, the hinge and the mounting swivel through an angle of up to about 90°, and a stretching of the elastic element takes place due to the swivelling. Here, too, the elastic element lifts itself continually off the radius of the mounting as well.

The inside lining also comprises the inside roof cover of a passage between two vehicles, in particular of a passage with a bellows. More particularly, the roof cover is characterized by individual lamellae forming the roof cover, which are received by one, preferably however, two, mountings, and which are movable relative to each other in the direction of the longitudinal axis of the mounting. The movability of the lamellae among one another can be achieved, for example, by arranging the lamellae vertically offset which are stable in themselves, extend transversely to the longitudinal axis of the vehicle, and are received by the mountings connecting the two vehicle bodies. Particularly in connection with a support for the mounting on the vehicle bodies that is pivotable in all three space directions, a roof cover is created that is capable of yielding to all travel movements occurring during the travel of a train.

According to a preferred embodiment of the invention the relative movability of the lamellae relative to each other, such movability being required, for example, when the spacing between the two vehicle bodies changes, is obtained in that the mounting comprises one, preferably however, two, spring telescopes, whereby the two spring telescopes are connected with each other by a center member. Specifically, the spring telescope has a compensation sleeve, which has a fastening means for receiving one lamella in each case. The support of the compensation sleeve on the spring telescope is achieved through a bearing sleeve which is axially movable and receives the compensation sleeve. In order to assure that the elements return to their starting position after a change in the spacing between two vehicle bodies, for example, due to travelling around a curve, the compensation sleeve is axially movably supported in its starting position in the axial direction by compensation springs, whereby the compensation springs are supported in this connection by the spring telescope. The center member, the compensation sleeve and the bearing sleeve each have one or two spring bearings for the compensation springs.

The spring telescope itself comprises a guide sleeve and a telescope sleeve, whereby the two sleeves are supported movable in each other relative to one another against the force of a telescope spring. In order to avoid any canting between the guide sleeve and the telescope sleeve, the two sleeves are is connected with each other by a guide bushing.

Not only the compensation sleeve but also the center member has fastening means for receiving a lamella. In this connection, the lamella is received by the fastening means displaceably in the direction of the longitudinal axis of the lamella. Such displacement takes place particularly when travelling through an S-curve.

A preferred embodiment is characterized in that the mounting comprises a telescope which has telescope bars and a telescope sleeve, whereby provision is made on the telescope sleeve for guide sleeves for receiving lamellae, and whereby for controlling the movement of the guide sleeves relative to one another, the guide sleeves are connected with one another by a scissors frame, whereby the scissors frame is articulated on the telescope bars on the end side. As opposed to the spring telescope known from the first embodiment, in connection with which the displacement took place force-locked because of the springs, a form-locked connection of the guide sleeves and thus of the lamellae among one another exists with this further embodiment due to the connection of the lamella through the scissors frame. Particularly due to the design of the scissors frame in the manner of a double scissors, a uniform displacement of the guide sleeves on the telescope sleeve is achieved. According to a special feature of this embodiment, the length of the scissors members is selected in such a way that the pushing together of the scissors frame takes place progressively. This constructional design takes into account the fact that when travelling through certain curve configurations, the displacement of the roof elements takes place asymmetrically. If such asymmetric displacement of the individual lamellae due to the progressive movement of the scissors frame would not be taken into consideration, there would be either the risk that gaps would form between the individual lamellae in the roof, or the risk that such gaps would adjoin each other due to the forced guidance by the scissors frame.

Furthermore, provision is made that for receiving the lamellae, there are fastening means within the zone of the points of intersection of the scissors members on the guide sleeves, in a way similar to the other embodiment with the spring telescope. Specifically, the fastening means comprises at least one, preferably however, two, vertically aligned U-shaped guide shoes opposing one another, whereby the lamella has a vertical bridge with a horizontally aligned U-shaped recess, whereby the guide shoes engage the legs of the U-shaped recess. The guide shoes are connected here with the bridge by return spring in order to return the lamella to the starting position after it has been deflected from that position.

BRIEF DESCRIPTION OF THE DRAWINGS

Other objects and features of the present invention will become apparent from the following detailed description considered in connection with the accompanying drawings which discloses the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
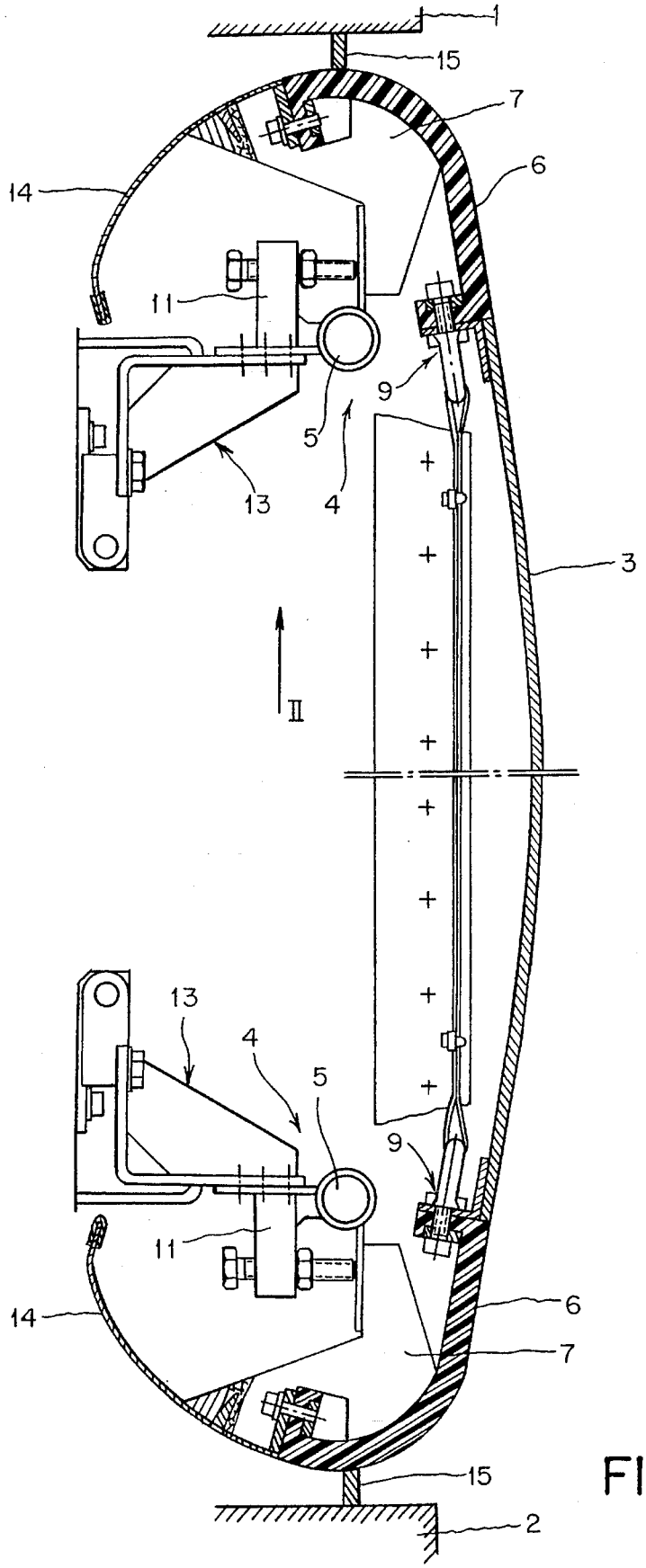
FIG. 1 shows a cross section top view of the side wall cover of one side of a passage.
Figure 2:
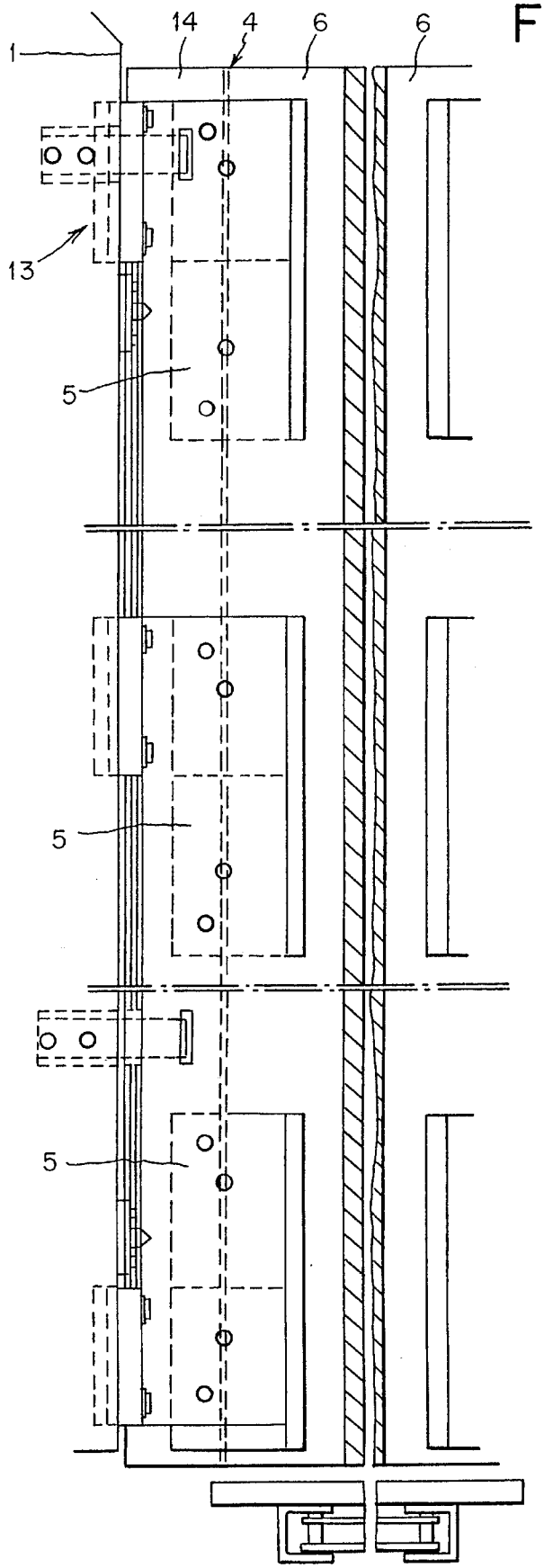
FIG. 2 shows a side view in the direction of arrow II in FIG. 1.

Turning now in detail to the drawings, FIG. 1 shows the side wall cover 3 for covering the bellows (not shown) connected with the respective car body 1, 2 by the elastic connection means, all of which are denoted by 4. Connection means 4 comprise three spring hinges 5 (FIG. 2) which are arranged one on top of the other and mounted on the coupling frame of the bellows (not shown) through the butt strap **5*b* (FIG. 3) by fastening means 13, and thus connected with the respective vehicle body 1, 2. Spring hinges 5 are fastened on the actual side wall cover 3 by elastic element 6**, which is designed in the way of a wall.

Figure 3:
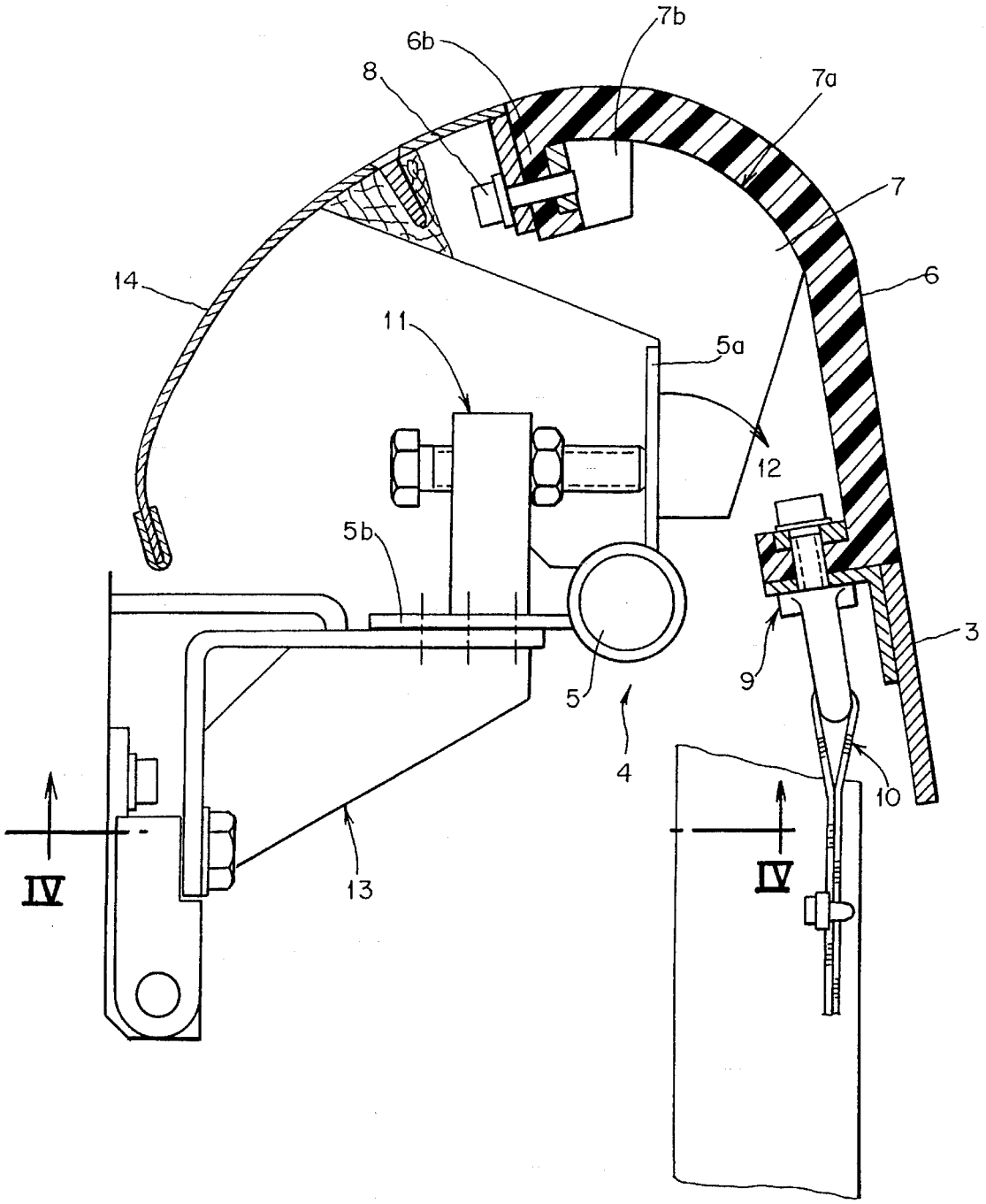
FIG. 3 shows an enlarged portion of the side wall cover according to FIG. 1.

For connecting the spring hinge 5 with the elastic element designed in the way of a wall, for example, a rubber like plate, provision is made for a mounting 7. The mounting 7 is connected with the spring hinge 5 by a butt strap **5*a* arranged on the spring hinge 5 (FIG. 3). The mounting 7, which, for example, is made of wood, is of a curved shape on its side 7*a* attached to the spring hinge 5. Within the range of the radius 7*a* created by the curved shape, the elastic element 6 rests against the mounting. For connecting the elastic element 6 with the mounting 7, the mounting has a recess 7*b*, in which the elastic element 6 rests with its bridge 6*b*. The bridge 6*b* of the elastic element 6 is fixed in the recess 7*b* by the screw connection 8**.

The elastic element 6 is connected with the side wall cover 3 by the connection member 9. The side wall cover 3 consists of an elastic but nevertheless relatively stiff material. Within the zone of the connection member 9, provision is made for a connection member 10, for example, in the form of a steel rope, for the connection with the connection member 9 on the opposite side of the side wall cover. For producing the arching in the direction of the center of the passage, the side wall cover is prestressed by the connection means.

Within the zone of the butt strap 5*a*, the stop 11 is arranged on said butt strap for limiting the path of swivel of said butt strap of the spring hinge 5.

Figure 6:
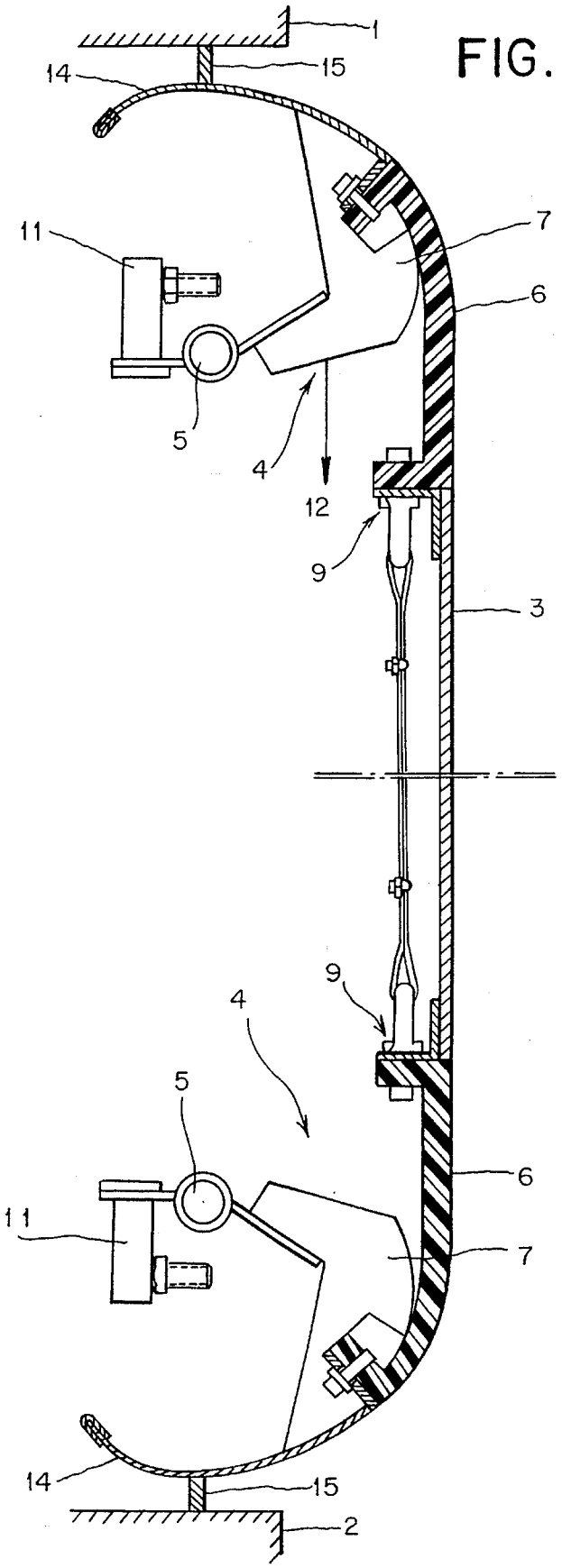
FIG. 6 shows schematically the position of the side wall cover within the range of the outer curve.

The position of the butt strap 5*a* on the stop 11 shown in FIGS. 1 and 3 represents the resting position. When a train fitted with such an inner wall lining travels through a curve, swivel motion of the butt strap 5*a* in the direction of arrow 12 takes place in the range of the outer curve (FIG. 6). Due to the movement of the butt strap 5*a* in the direction of the arrow 12, a movement of the elastic element 6 in the direction of arrow 12 takes place due to the swivel path. This causes the elastic element 6 to deform because when the end position is reached, which is the case after travelling through an angle of about 90°. This element is no longer resting against the radius 7*a* of the mounting 7.

Figure 4:
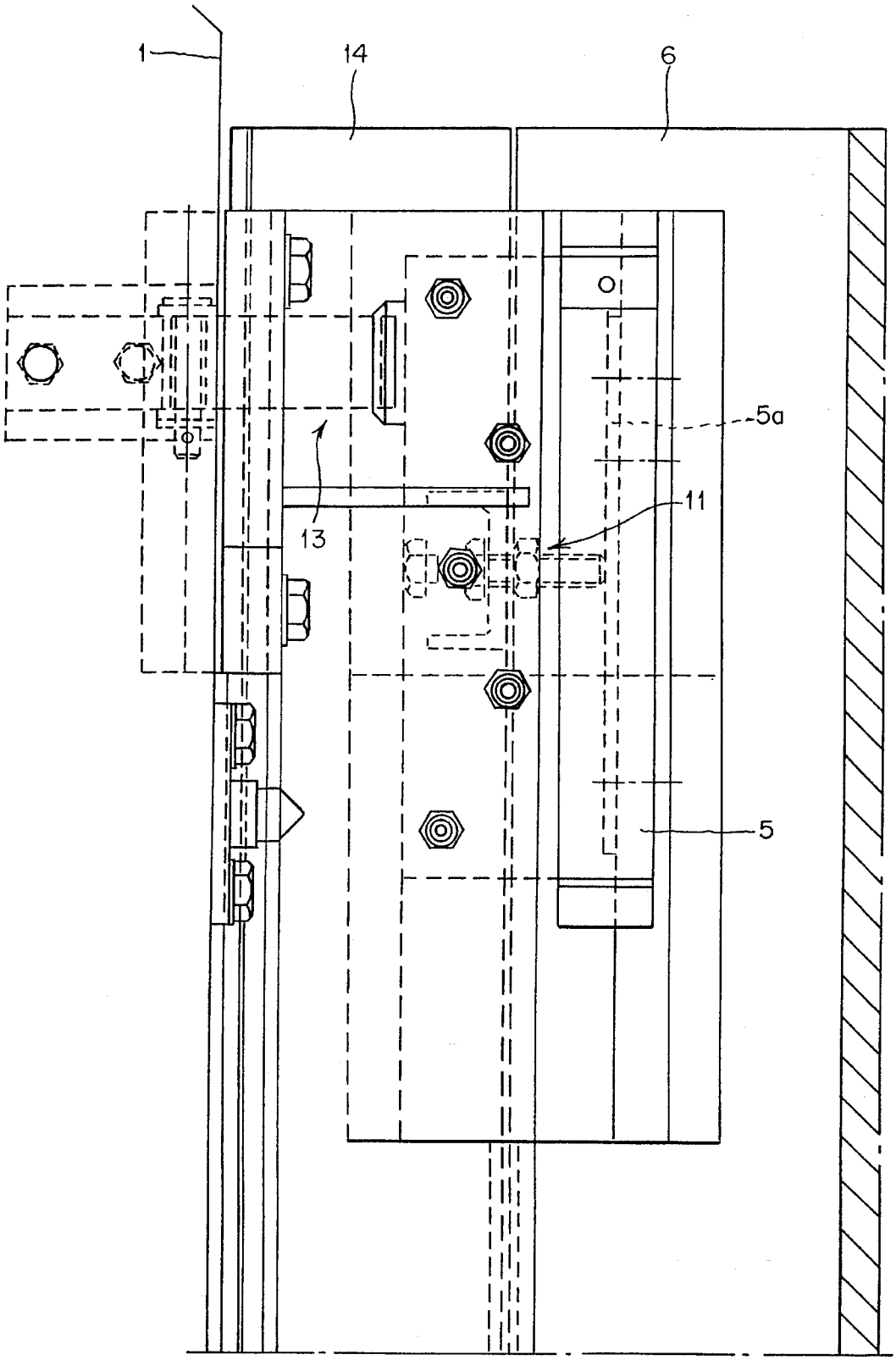
FIG. 4 shows a side view in the direction of line IV—IV in FIG. 3.

Provision is made for a cover 14 (FIG. 4) in order to prevent the zone of the spring hinge 5 from being engaged after the hinge 5 has been swivelled.

By designing the hinge as a spring hinge, a corresponding reset motion is exerted on the elastic element 6, which is designed as a wall, after travelling through the curve in such a way that the butt strap 5*a* is reset against the direction of the arrow 12 by the spring arranged in the spring hinge.

Figure 5:
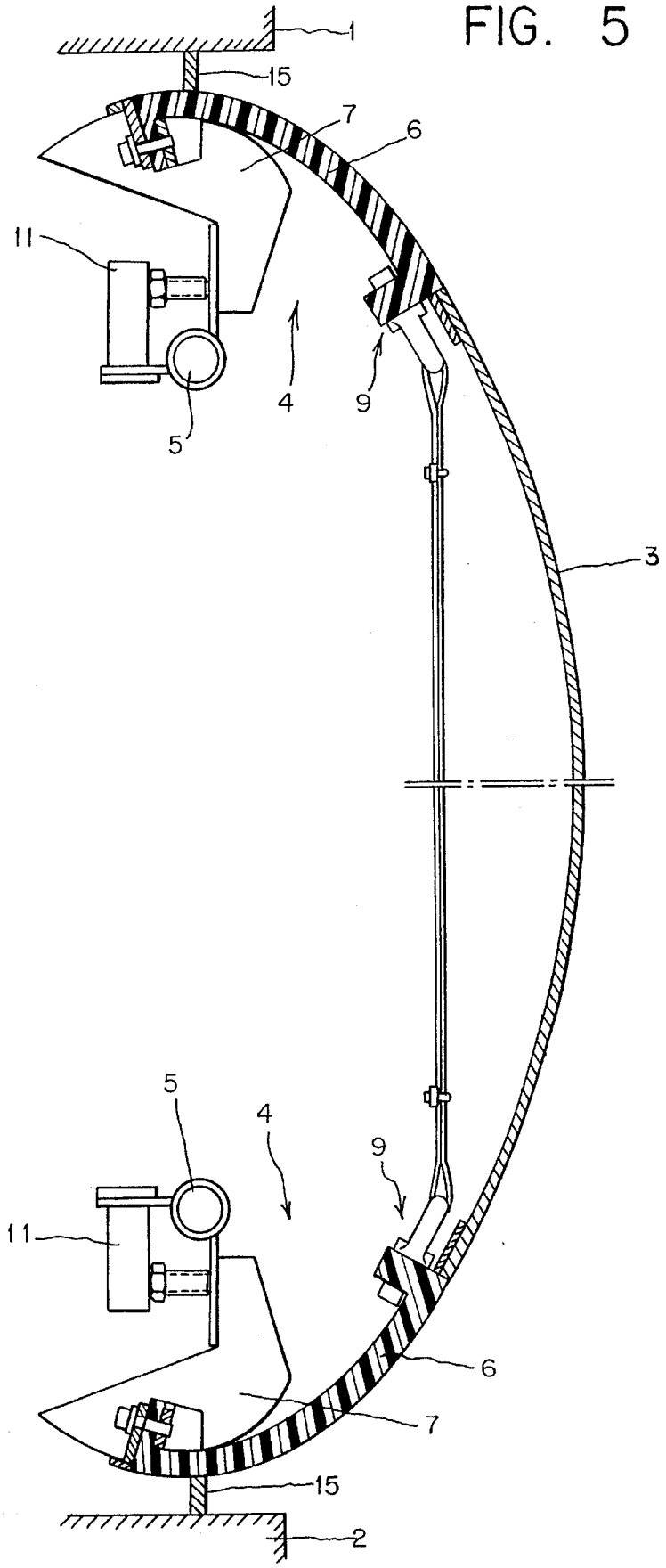
FIG. 5 shows schematically the position of the side wall cover within the range of the inner curve.

Within the range of the inner curve (FIG. 5), the required shortening of the side wall cover is achieved by a further bulging of the side wall cover 3 in the direction of the center of the passage. Here, too, the elastic element 6 lifts itself off the radius 7*a* as well.

For screening the gap between the connection means 4 and the car body 1, 2, provision is made for a gap cover (FIG. 6). Due to the fact that the radius 7*a* of the mounting 7 and the radius of the cover 14 are the same and extend approximately parallel with the swivel radius of the butt strap 5*a* of the spring hinge 5, no further gap is formed during swivelling between the gap cover 15 and the surface of the elastic element 6 or cover 14.

Figure 7:
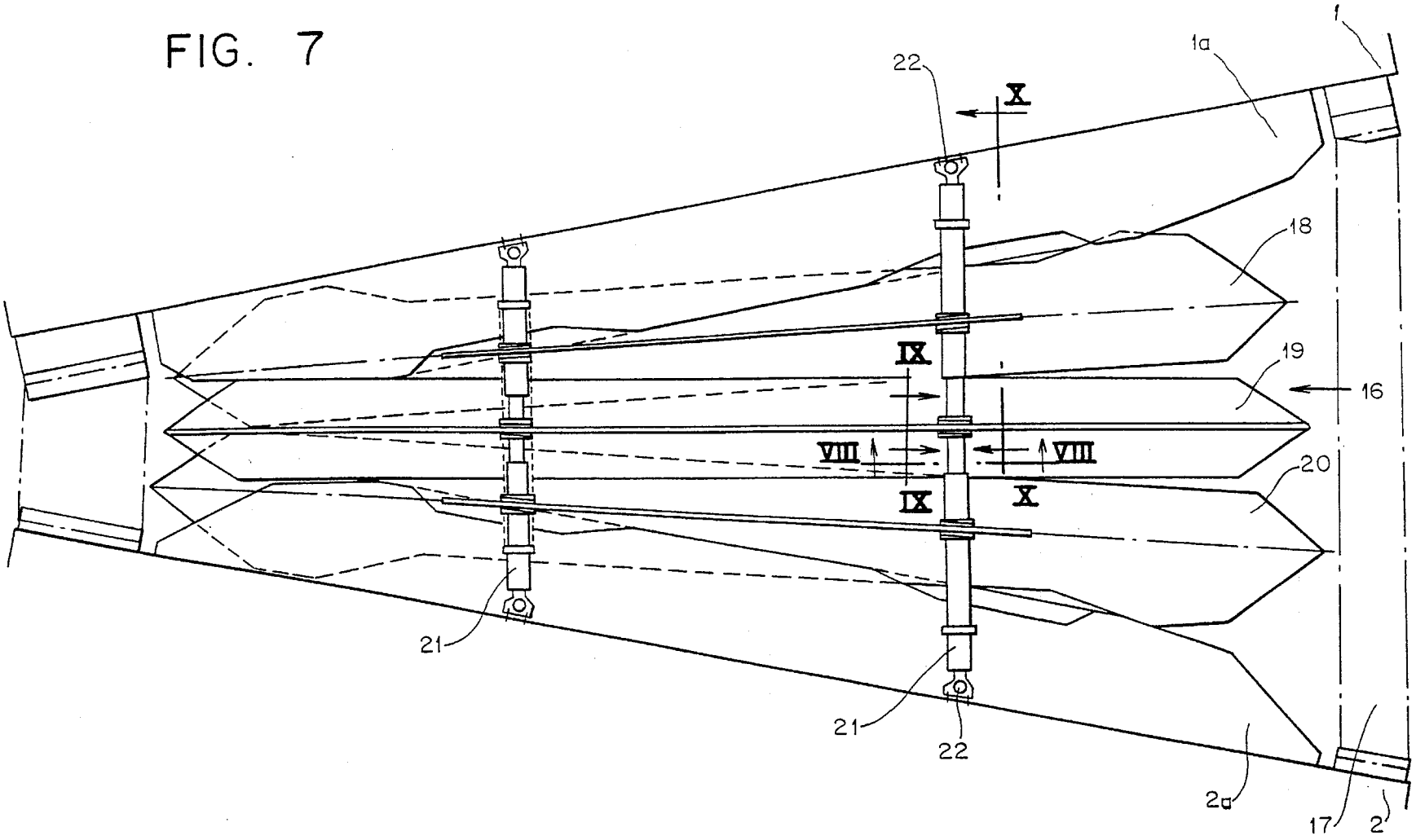
FIG. 7 shows a top view of the first embodiment of a roof cover.
Figure 11:
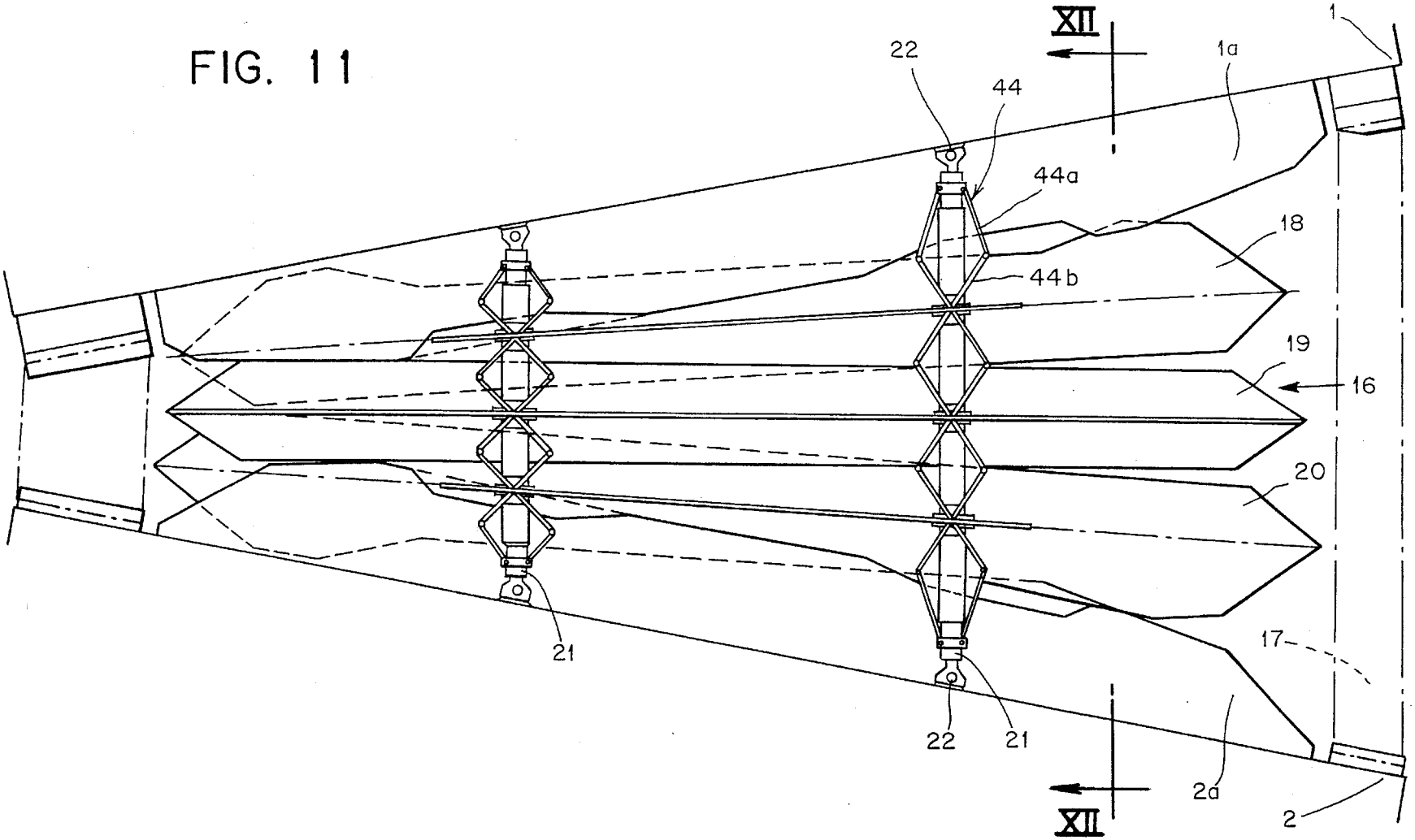
FIG. 11 shows a top view of the second embodiment of a roof cover.

According to FIGS. 7 and 11, roof cover 16 is arranged between the two car bodies 1 and 2. The roof cover is disposed within the bellows, which is indicated in FIGS. 7 and 11 and denoted by the reference numeral 17.

More particularly, the roof cover denoted by 16 consists of the individual lamellae 18, 19 and 20 which are arranged at different levels and received by the two mountings denoted by 21. Furthermore, the lamella attachments 1*a*, 2*a* are present on the car bodies 1, 2, respectively, which attachments together with the lamellae 18 to 20 effect a complete covering of the roof formed by the bellows. Both the lamellae 18 to 20 and the lamellae 1*a* and 2*a* each are designed pointed at their end sides in order to permit the roof cover to be pushed together while travelling through a curve. The mountings 21 are in each case connected with the car bodies 1 and 2 by a ball bearing mounting 22. It is achieved through such a ball bearing 22 that the mounting is movably received by the bearing 22 both horizontally and within certain limits also vertically, so that diagonal motions and movements between the two cars can be accommodated.

Figure 9:
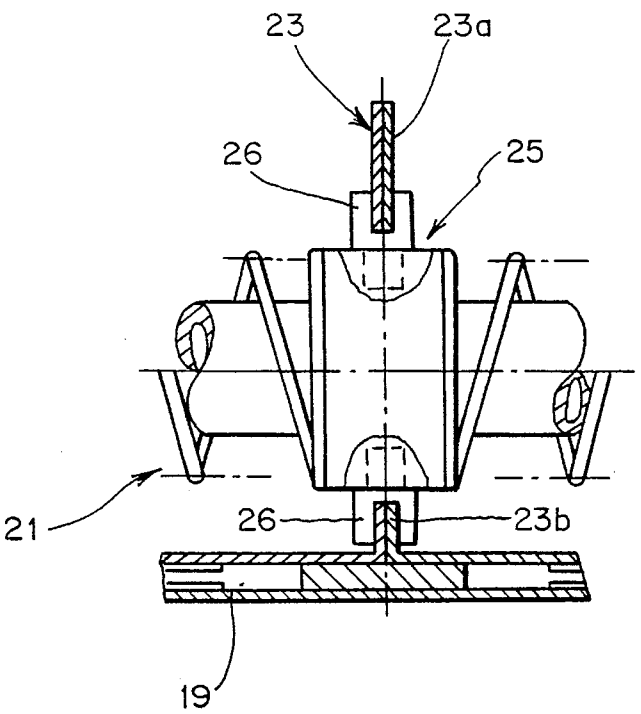
FIG. 9 shows a section view along line IX—IX of FIG. 7.
Figure 8:
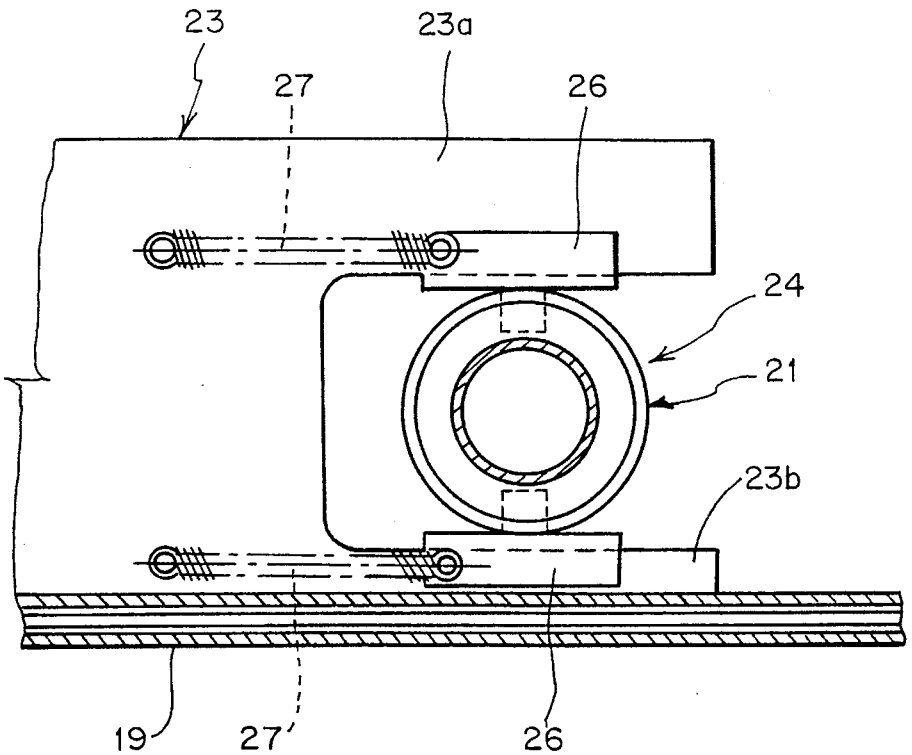
FIG. 8 shows a section view along line VIII—VIII of FIG. 7.

The attaching of the lamella 19 by the mounting 21 can be seen in FIGS. 8 and 9. For receiving the lamella 19 by the mounting 21, the lamella 19 has a bridge 23 having a horizontally aligned U-shaped recess 24. The mounting 21 is supported in this U-shaped recess 24. Within the zone of the U-shaped recess 24, the mounting 21 (in the present case the center member 25 of the mounting 21 of FIG. 9) has the two vertically aligned U-shaped guide shoes 26, which are disposed opposite each other and which engage in the legs 23*a*, 23*b* of the bridge 23. The shoes 26 each are connected with the bridge 23 by the springs 27 in order to pull the lamella back into its starting position relative to the mounting 21 after a displacement. The attachment of the lamellae 18 and 20 on the mounting 21 is basically obtained in the same way.

Figure 10:
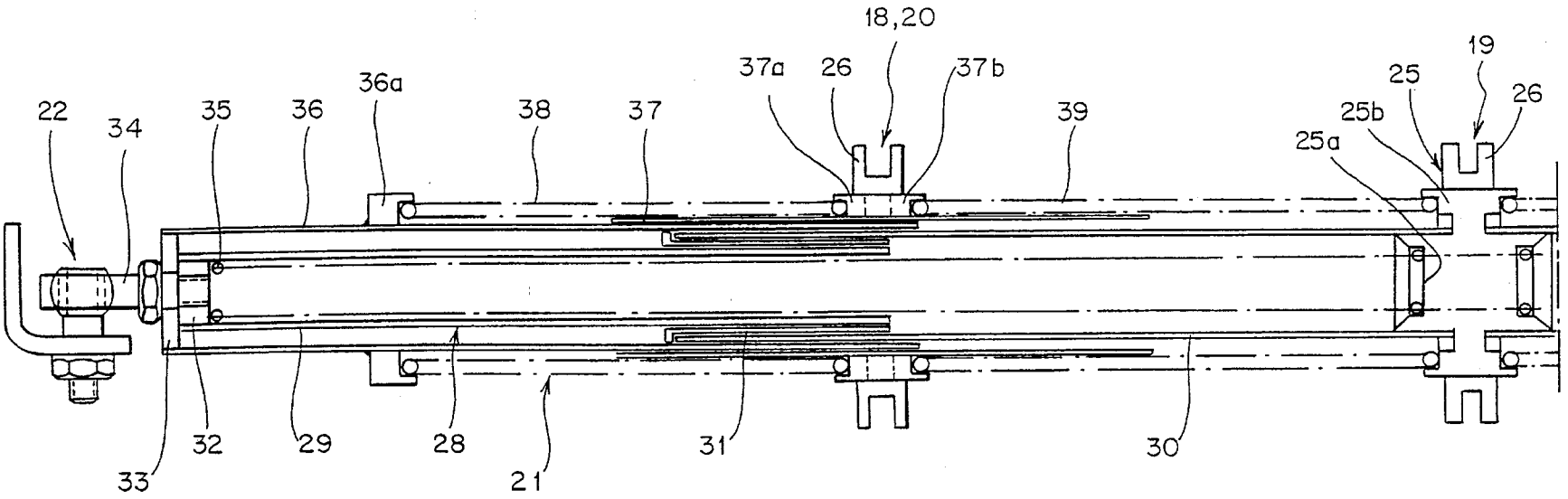
FIG. 10 shows a section view along line X—X of FIG. 7.

FIG. 10 shows a first embodiment of the mounting 21, whereby only the one side of the mounting is shown. The mounting 21 is swivel-mounted for three-dimensional movement by the ball bearing 22 arranged on the car body 1, 2. Specifically, mounting 21 includes a spring telescope, which as a whole is denoted by 28. This spring telescope includes a guide sleeve 29 and the telescope sleeve 30 connected with each other and displaceable relative to one another by a guide bushing 31. In this connection, the telescope sleeve 30 is supported by the center member 25. The guide sleeve 29 is seated at each end on a collar 32, which is a component of the bearing disk 33, whereby the bearing disk 33 is connected with the ball bearing 22 through a bearing member 34. The guide sleeve 29 and the telescope sleeve 30 receive the spring which, at each end, rests against the collar 32 and the face-side surface of the groove 25*a* of the center member 25.

The bearing disk 33, furthermore, has the bearing sleeve 36, whereby the compensation sleeve 37 is longitudinally movably arranged on the bearing sleeve and the telescope sleeve, which is supported also on the telescope sleeve 30.

The compensation sleeve 37, like the center member 25, has fastening means in the form of the U-shaped guide shoes 26 for receiving lamellae 18 and 20 by the legs 23*a* and 23*b*, respectively, of the bridge 23. The type of attachment of the lamellae here conforms to the one for the lamella 19 on the center member 25. The bearing sleeve 36 comprises the spring bearing 36*a*, the compensation sleeve 37 and the spring bearing 37*a*. The compensation spring 38 is disposed between the two bearings 36*a* and 37*a*. Furthermore, the compensation sleeve 37 has within the zone of the guide shoe 26 the further spring bearing 37*b*, whereby correspondingly, the center member 25 also has a spring bearing 25*b*. A compensation spring 39 is again disposed between the two spring bearings 37*b* and 25*b*. The compensation springs 38 and 39 assure that following a deflection, for example, due to movement of the vehicle around a curve, the compensation sleeve 37 and thus also the lamellae 18 and 20 are reset to their starting positions.

Figure 12:
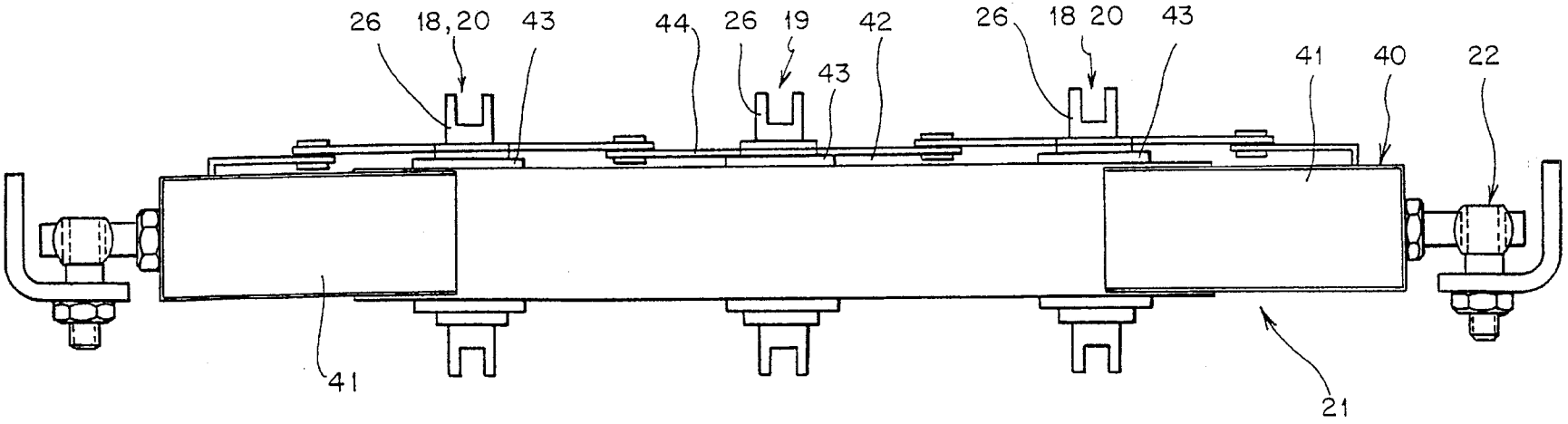
FIG. 12 shows a section view along line XII—XII of FIG. 11.

FIG. 11 shows a top view of the second embodiment for a roof cover. The mounting, which as a whole is denoted by 21 and is also supported by the vehicle bodies 1, 2 by a ball bearing 22, includes a telescope (FIG. 12) denoted as a whole by 40. This telescope includes the two telescope bars 41, which are connected by a telescope sleeve 42. The guide sleeves 43 are supported on the telescope sleeve 42, which guide sleeves have the fastening means 26 for receiving the lamellae 18, 19 and 20, on the one hand, and which, furthermore, are connected with each other form-locked by the scissors frame denoted as a whole by 44 (FIG. 12). The construction of the fastening means 26 conforms to the representation according to FIGS. 8 and 9, whereby in the present case, provision is made for the scissors frame 44 instead of for the spring 38.

The scissors frame itself comprises the scissors members 44*a* and 44*b*, which are different in length. The scissors member 44*a*, which forms the end member, is here about half as long as the scissors member 44*b*, which is the center member. The different length of the scissors members was selected in order to achieve a progressive development of the movement of the guide sleeves 43 and thus of the lamellae 18, 19 and 20 relative to one another when the telescope 40 is pushed together, the lamellae being articulated on the guide sleeves.

While several embodiments of the present invention have been shown and described, it is to be understood that many changes and modifications may be made thereunto without departing from the spirit and scope of the invention as defined in the appended claims.

What is claimed is:

1. Inside lining of a passage between two vehicles, with each vehicle having a body, said lining comprising a side wall cover which comprises a plate inherently elastically yielding and being arched around a vertical axis of a plane in a direction of a center of the passage;

an elastically yielding hinge connecting means for connecting the side wall cover with the body of the two vehicles;

wherein the elastically yieldingly connecting means comprises an elastic wall element connecting the hinge with the side wall cover;

wherein the hinge has a zone of articulation; and within the zone of articulation of the hinge, further comprising a stop for the hinge for limiting the swivel angle.

2. Inside lining according to claim 1, further comprising means for articulately connecting the side wall cover with each body of the two vehicles.

3. Inside lining according to claim 1, wherein said hinge is a spring hinge.

4. Inside lining according to claim 3, comprising means for prestressing the spring hinge in such a way that the side wall cover is pulled in the direction of a body for each respective vehicle.

5. Inside lining according to claim 1, wherein said passage has a longitudinal axis;

wherein the hinge is arranged next to the side wall cover; and wherein the hinge is articulated on said elastic element approximately parallel with a line parallel with said longitudinal axis of the passage, so that the elastic element extends at the end side angularly relative to the longitudinal axis of the passage.

6. Inside lining according to claim 5, further comprising a butt strap on the hinge for receiving a mounting, on which the elastic element is articulated.

7. Inside lining according to claim 6, wherein the mounting has a radius, whereby the elastic element rests against the radius.

8. Inside lining according to claim 7, further comprising a gap cover between the vehicle body and the connection means, whereby the gap cover is arranged on the vehicle body.

9. Inside lining according to claim 1, further comprising a cover for the elastic element in order to screen the space around the spring hinge when the hinge is swivelled.

10. Inside lining according to claim 1, further comprising a roof cover, comprising individual lamellae forming the roof cover, said lamellae being received by at least one mounting, whereby two mountings would be movable relative to each other in the direction of the longitudinal axis of the mounting.

11. Inside lining according to claim 10, wherein the lamellae extend transversely to the longitudinal axis of the vehicle and are received by two mountings connecting the two vehicle bodies.

12. Inside lining according to claim 10, wherein the mounting comprises at least one spring telescope, whereby two spring telescopes would be connected with each other by a center member.

13. Inside lining according to claim 12, wherein the spring telescope has a compensation sleeve having the fastening means for receiving a lamella.

14. Inside lining according to claim 13, whereby the compensation sleeve is supported in its starting position axially movable in the axial direction by compensation springs, whereby the compensation springs are supported by the spring telescope.

15. Inside lining according to claim 14, wherein the center member, the compensation sleeve and the bearing sleeve each have at least one spring bearing for the compensation springs.

16. Inside lining according to claim 13, wherein the spring telescope has a bearing sleeve axis movably receiving the compensation sleeve.

17. Inside lining according to claim 12, wherein the spring telescope comprises a guide sleeve and a telescope sleeve, whereby the two sleeves are supported in one another movable relative to each other against the force of a telescope spring.

18. Inside lining according to claim 17, wherein the two sleeves are connected with each other by a guide sleeve.

19. Inside lining according to claim 12, wherein there is a center member; and wherein the center member has fastening means for receiving a lamella.

20. Inside lining according to claim 19, wherein there is a mounting; and wherein the lamella is connected by the fastening means with the mounting displaceable in the direction of the longitudinal axis of the lamella.

21. Inside lining according to claim 10, wherein the mounting is arranged on the respective vehicle body pivotably in all three dimensional space.

22. Inside lining of a passage between two vehicles, with each vehicle having a body, said lining comprising a side wall cover which comprises a plate inherently elastically yielding and being arched around a vertical axis of a plane in a direction of a center of the passage;

a roof cover, comprising individual lamellae forming the roof cover, said lamellae being received by at least one mounting, whereby two mountings would be movable relative to each other in the direction of the longitudinal axis of the mounting;

wherein the lamellae extend transversely to the longitudinal axis of the vehicle and are received by two mountings connecting the two vehicle bodies; and wherein the mounting comprises a telescope, wherein the telescope has telescope bars and a telescope sleeve, whereby provision is made on the telescope sleeve for guide sleeves for receiving lamellae and whereby for controlling the movement of the guide sleeves relative to each other, the guide sleeves are connected with each other by a scissors frame, whereby the scissors frame is connected with the telescope bars.

23. Inside lining according to claim 22, wherein the scissors frame is designed in the way of a double scissors.

24. Inside lining according to claim 22, wherein the length of the scissors members is selected in such a way that the pushing together of the scissors frame takes place progressively.

25. Inside lining according to claim 22, wherein for receiving the lamellae, provision is made within the zone of the points of intersection of the scissors members for fastening means on the guide sleeves.

26. Inside lining according to claim 22, wherein the fastening means comprises two oppositely arranged, vertically aligned U-shaped guide shoes, whereby the lamella has a vertical bridge with a horizontally aligned U-shaped recess, whereby the guide shoes engage the legs of the U-shaped recess.

27. Inside lining according to claim 26, wherein the guide shoes are connected with the bridge by return springs.

* * * * *